US006595273B2

(12) United States Patent
Shimoya

(10) Patent No.: US 6,595,273 B2
(45) Date of Patent: Jul. 22, 2003

(54) HEAT EXCHANGER

(75) Inventor: Masahiro Shimoya, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/195,618

(22) Filed: Jul. 15, 2002

(65) Prior Publication Data

US 2003/0029608 A1 Feb. 13, 2003

(30) Foreign Application Priority Data

Aug. 8, 2001 (JP) ..... 2001-241308
Apr. 12, 2002 (JP) ..... 2002-110124

(51) Int. Cl.[7] ..... F28D 1/02

(52) U.S. Cl. ..... 165/152; 165/176; 165/173; 165/177

(58) Field of Search ..... 165/152, 153, 165/173, 174, 176, 177; 29/890.052, 890.053

(56) References Cited

U.S. PATENT DOCUMENTS 1,993,872 A * 3/1935 Chase ..... 165/176
1,998,663 A * 4/1935 Emmons et al. ..... 165/176
3,757,855 A * 9/1973 Kun et al. ..... 165/148
4,470,452 A * 9/1984 Rhodes ..... 165/153
4,932,469 A 6/1990 Beatenbough
5,441,105 A * 8/1995 Brummett et al. ..... 165/153
6,453,988 B1 * 9/2002 Nakado et al. ..... 165/152
6,453,989 B1 * 9/2002 Watanabe et al. ..... 165/177
6,478,080 B2 * 11/2002 Pinto ..... 165/153

FOREIGN PATENT DOCUMENTS

CA 1133892 10/1982
JP 2000-161896 6/2000

* cited by examiner

*Primary Examiner*—Henry Bennett
*Assistant Examiner*—Terrell McKinnon
(74) *Attorney, Agent, or Firm*—Harness, Dickey & Pierce, PLC

(57) ABSTRACT

A laminated-type heat exchanger has plural flat tubes in which refrigerant flows and plural corrugated fins each of which is disposed between adjacent two flat tubes. In the heat exchanger, plural protrusion portions protrude from an outer wall surface of each flat tube toward the corrugated fins, so that recess portions through which air flows are provided at least between adjacent protrusion portions. The protrusion portions are provided such that air meanderingly flows through the recess portions from an upstream end side to a downstream end side of each tube in a flow direction of air.

20 Claims, 10 Drawing Sheets

HEAT EXCHANGER

CROSS REFERENCE TO RELATED APPLICATION

This application is based on Japanese Patent Applications No. 2001-241308 filed on Aug. 8, 2001, and No. 2002-110124 filed on Apr. 12, 2002, the disclosure of which is incorporated herein by reference.

FIELD OF THE INVENTION

The present invention relates to a heat exchanger used for a refrigerant cycle for a vehicle or a home, for example. More particularly, the present invention relates to a structure for improving a heat exchange between a first fluid flowing inside tubes and a second fluid flowing outside the tubes in a laminated-type heat exchanger.

BACKGROUND OF THE INVENTION

In a laminated-type heat exchanger used for a condenser of a refrigerant cycle of an air conditioner, as shown in FIG. 13, a heat-exchanging portion is constructed by plural fins 101 and tubes 103. In addition, two headers are provided to be connected to one end and the other end of the tubes 103, respectively, to communicate with the tubes 103. However, because louvers 104 are provided in the fins 101 for facilitating a heat exchange with air while each outer wall surface of the tubes 103 is formed into a flat surface, heat-transmitting performance on the air side is not sufficiently improved.

On the other hand, in a heat exchanger described in JP-A-2000-161896, as shown in FIGS. 14A and 14B, protrusion portions 108 or dimple portions 105 (recesses) are provided in each outer wall surface of tubes 103 having end portions inserted into insertion holes 107 of a header 106. However, the protrusion portions 108 or the dimple portions 105 become a dead region relative to a flow of air, and air does not flow through the dead region. Accordingly, the protrusion portions 108 or the dimple portions 105 are not used for improving the heat-transmitting performance on the air side.

SUMMARY OF THE INVENTION

In view of the foregoing problems, it is an object of the present invention to provide a heat exchanger having a plurality of tubes for performing a heat exchange between a first fluid flowing inside the tubes and a second fluid flowing outside the tubes, which effectively improves heat-transmitting performance on a side of the second fluid.

According to the present invention, a heat exchanger includes a plurality of flat tubes disposed for performing a heat exchange between a first fluid flowing inside the tubes and a second fluid flowing outside the tubes, and a plurality of heat transmitting members for increasing a heat-exchanging efficiency between the first fluid and the second fluid. Each of the heat-transmitting members is disposed between adjacent tubes, and has contact portions contacting an outer wall surface of each tube adjacent to each heat transmitting member. In the heat exchanger, each of the tubes has a plurality of protrusion portions protruding from the outer wall surface of each tube toward the heat transmitting members to define a fluid passage at least between adjacent protrusion portions or around the protrusion portions such that the second fluid passes through the fluid passage between adjacent protrusion portions. Accordingly, the second fluid flowing through the fluid passage is also used for performing the heat exchange with the first fluid flowing inside the tubes, heat-transmitting performance on the second fluid side can be improved.

Preferably, the fluid passage is provided between the outer wall surface of each tube and the contact portions of each heat-transmitting member, and is constructed by at least groove-shaped recess portions between adjacent protrusion portions or around the protrusion portions. Therefore, the second fluid readily passes through the recess portions without staying in the recess portions. In addition, the fluid passage has at least one side opening between inlet side openings for introducing the second fluid into the recess portions and outlet side openings for allowing the second fluid to flow out from the recess portions, the inlet side openings are provided at an upstream end of each tube in a flow direction of the second fluid, and the outlet side openings are provided at a downstream end of each tube in the flow direction of the second fluid. Accordingly, the second fluid readily passes through the recess portions on the outer wall surface of each tube while effectively performing a heat exchange with the first fluid. When both the inlet side openings and the outlet side openings are provided, the second fluid is introduced into the recess portions through the inlet side openings, and thereafter, flows out from the recess portions through the outlet side openings. Therefore, in this case, the second fluid further effectively flows through the recess portions, and heat-transmitting performance on the second fluid side can be effectively improved.

Alternatively, according to a heat exchanger of the present invention, the fluid passage through which the second fluid flows can be provided in intermediate plates each of which is disposed adjacent the tube and the heat transmitting member. Because the fluid passage is provided in each of the intermediate plates contacting flat outer wall surfaces of flat tubes, the second fluid flowing through the fluid passage is also heat-exchanged with refrigerant flowing inside the tubes, and heat-transmitting performance on the second fluid side can be improved. Even in this case, the fluid passage can be constructed by a plurality of recess portions recessed in a plate thickness direction of each intermediate plate, and the fluid passage has at least one side opening between inlet side openings from which the second fluid flows into the recess portions, and outlet side openings from which the second fluid flows out from the recess portions. Accordingly, in the heat exchanger, the second fluid readily flows through the recess portions provided in the intermediate plates, and heat-exchanging efficiency on the second fluid side can be further improved.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENTS

A first preferred embodiment of the present invention will be now described with reference to FIGS. 1–4. In the first embodiment, a laminated-type heat exchanger of the present invention is typically used for a condenser of a refrigerant cycle of a vehicle air conditioner, and the condenser is located at a position in an engine compartment of a vehicle, at which outside air is readily received when the vehicle is running.

Figure 1:
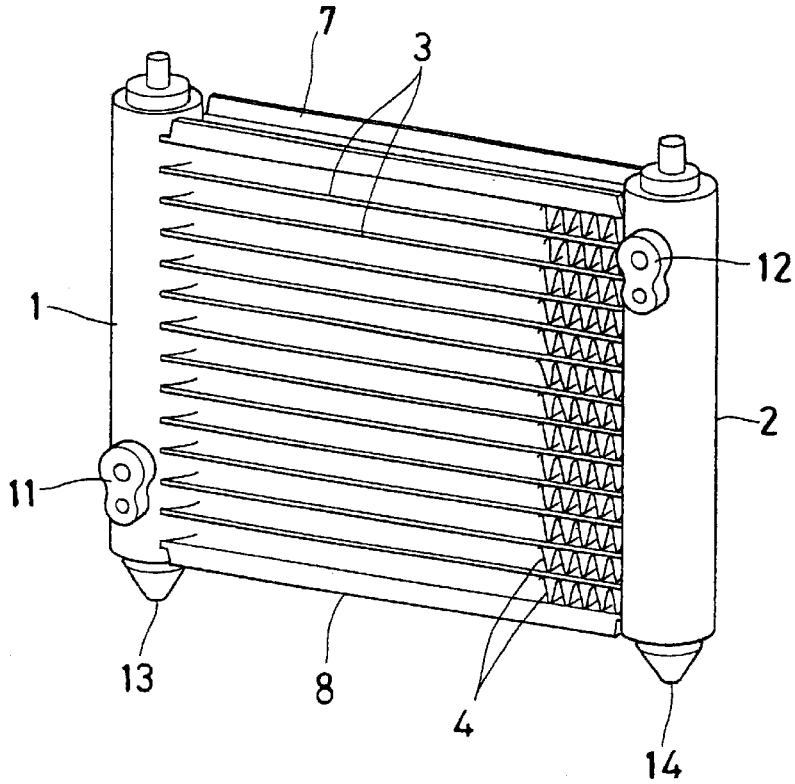
FIG. 1 is a perspective view showing an entire structure of a laminated-type heat exchanger according to a first embodiment of the present invention.

As shown in FIG. 1, the laminated-type heat exchanger includes a heat-exchanging portion for performing a heat exchange between refrigerant (i.e., first fluid) and air (i.e., second fluid), a first header 1 disposed at one side (e.g., left side in FIG. 1) of the heat-exchanging portion, and a second header 2 disposed at the other side (e.g., right side in FIG. 1) of the heat-exchanging portion. The heat-exchanging portion has plural flat tubes 3 in which refrigerant flows, and plural corrugated fins 4 disposed to contact outer wall surfaces of the tubes 3. The tubes 3 and the corrugated fins 4 are alternately laminated in a laminating direction (up-down direction in FIG. 1). In the first embodiment, louvers for increasing heat-transmitting efficiency between refrigerant and air are not provided in the corrugated fins 4. The first and second headers 1, 2, the plural tubes 3, the plural fins 4 and connection blocks 11, 12 are integrally brazed in a furnace by a brazing material clad on the first and second headers 1, 2 and the plural tubes 3.

The first header 1 is made a metal such as an aluminum allow, and is formed into a cylindrical shape. While the plural tubes 3 are inserted into insertion holes (not shown) of the first header 1, the one side ends of the plural tubes 3 are bonded to the first header 1 by brazing. Further, the connection block 11, to which an inlet pipe for introducing refrigerant therein is connected, is bonded to a lower side part of the first header 1.

The second header 2 is made a metal such as an aluminum allow, and is formed into a cylindrical shape. While the plural tubes 3 are inserted into insertion holes (not shown) of the second header 2, the other side ends of the plural tubes 3 are bonded to the second header 2 by brazing. Further, the connection block 12, to which an outlet pipe for discharging refrigerant is connected, is bonded to an upper side part of the second header 2. In addition, engagement protrusion portions 13, 14, through which the heat exchanger is mounted on the vehicle, are provided at bottom ends of the first and second headers 1, 2, respectively.

Figure 2:
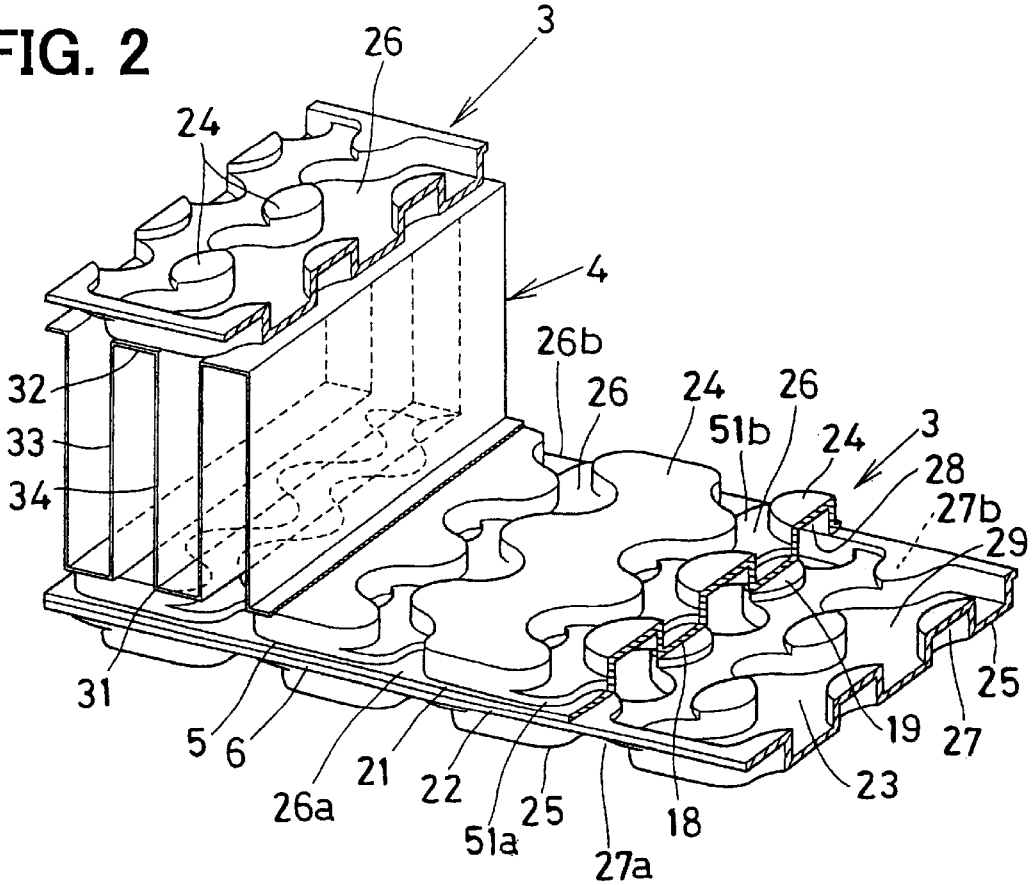
FIG. 2 is a perspective view showing a main structure of a heat-exchanging portion of the laminated-type heat exchanger, according to the first embodiment.

Each of the tubes 3 is formed into a flat shape, by bonding a pair of molding plates 5, 6, to define therein a refrigerant passage through which refrigerant flows. The tubes 3 are laminated (stacked) in the laminating direction (up-down direction in FIG. 1) to have a predetermined distance between adjacent two tubes 3. As shown in FIG. 2, outer peripheral ends 21, 22 are provided integrally with opposite inner wall surfaces of the pair of the molding plates 5, 6, respectively, so that a refrigerant passage 23 is defined within the outer peripheral ends 21, 22 in the tube 3.

Plural protrusion portions 24, 25 protruding from outer wall surfaces of the molding plates 5, 6 are provided in the molding plates 5, 6, so that plural recess portions 26, 27 are provided between adjacent two protrusion portions 24, 25. Because the protruding portions 24, 25 protrudes outside, the refrigerant passage 23 is formed within the outer peripheral ends 21, 22. Each of the protrusion portions 24, 25 is composed of a wave-shaped side wall surface and a protruding top end surface (bottom surface), and is embossed on the outer peripheral ends 21, 22 (recess portions 26, 27) by a predetermined protrusion dimension. Each of the protrusion portions 24, 25 has a cross-section shape shown in FIG. 2, such as a one-side opened rectangular shape, a U-shape and a C-shape.

The recess portions 26, 27 between adjacent protrusion portions 24, 25 define an air passage (i.e., fluid passage) between each tube 3 and contacting portions 31, 32 of each fin 4. Inlet opening portions 26*a*, 27*a* for introducing air into the recess portions 26, 27 are provided at an upstream end portion of the tube 3 in a flow direction of air. On the other hand, outlet opening portions 26*b*, 27*b* for discharging air from the recess portions 26, 27 are provided at a downstream end portion of the tube 3 in the flow direction of air. In the first embodiment, the recess portions 26, 27 are formed into wave shapes such that air from the inlet opening portions 26*a*, 27*a* flows meanderingly toward the outlet opening portions 26*b*, 27*b*.

In the first embodiment, step portions 51*a* are provided in the inlet opening portions 26*a*, 27*a*, and step portions 51*b* are provided in the outlet opening portions 26*b*, 27*b*, so that an air flow is disturbed and heat-transmitting performance on the air side is improved. For example, a step height of each step portion 51*a,* 51*b* is 0.65 mm. However, the step portions 51*a,* 51*b* may be omitted.

In the first embodiment, as shown in FIG. 2, the protrusion portions 24 and the recess portions 26 of the molding plate 5, and the protrusion portions 25 and the recess portions 27 of the molding plates 6 are slightly offset from each other in a longitudinal direction of the pair of the molding plates 5, 6. Each tube 3 is formed by bonding the pair of the molding plates 5, 6 to form the refrigerant passage 23.

Accordingly, refrigerant in the refrigerant passage 23 passes through recess portions 28 formed inside the protrusion portions 24 of the molding plate 5, then passes through recess portions 29 formed inside the protrusion portions 25 of the molding plate 6, then passes through the recess portions 28 formed inside the protrusion portions 24 of the molding plate 5, and then passes through recess portions 29 formed inside the protrusion portions 25 of the molding plate 6. That is, refrigerant passes through the refrigerant passage 23 from the first header 1 to the second header 2, while alternately passing through the recess portions 28 formed inside the protrusions portions 24 of the molding plate 5 and the recess portions 29 formed inside the protrusions portions 25 of the molding plate 6. In the first embodiment, in order to increase the pressure-resistance strength of the tube 3, connection portions 18, 19 at which both the plates 5, 6 are connected are provided.

Figure 3A:
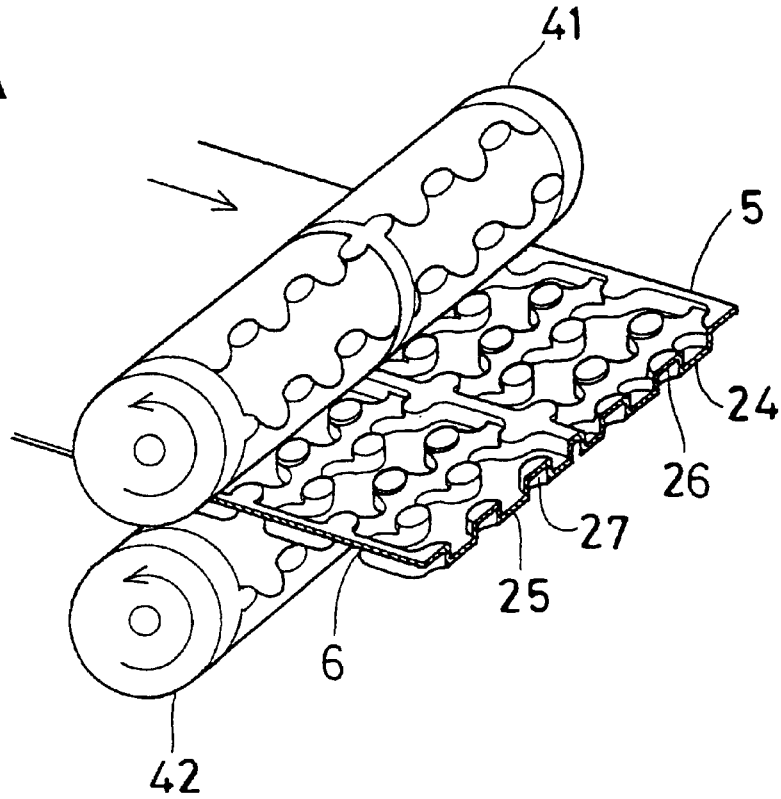
FIG. 3A is a perspective view showing a molding roller for forming a tube.
Figure 3B:
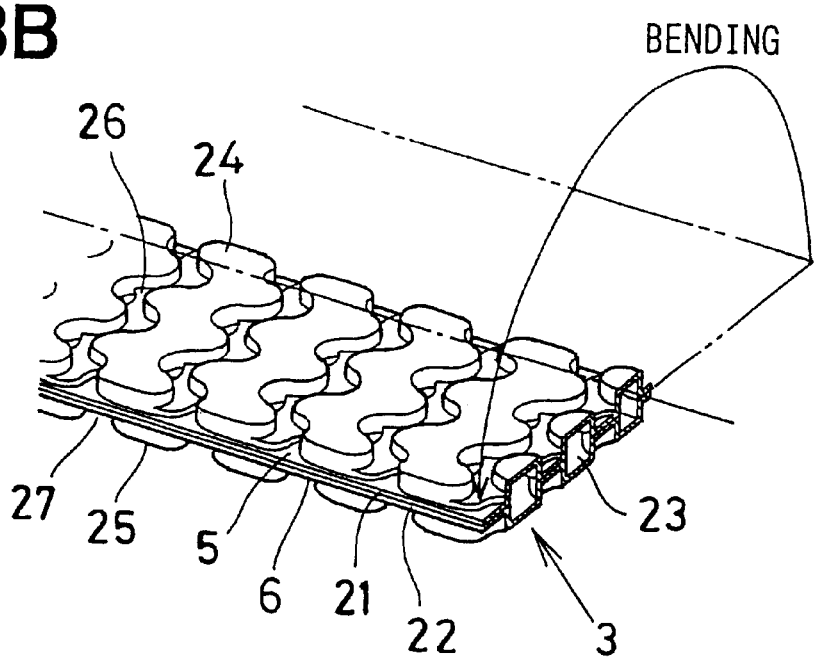
FIG. 3B is a schematic diagram showing a bending state for forming the tube, according to the first embodiment.

Each of the tubes 3 shown in FIGS. 1 and 2 is manufactured as shown in FIGS. 3A and 3B, for example. That is, as shown in FIG. 3A, a thin metal plate made of an aluminum allow or the like is molded by rollers 41, 42 to form protrusion and recess shapes. Thereafter, as shown in FIG. 3B, the plate molded by the rollers is bent at a center portion so that the tube 3 is formed. The tube 3 may be formed by bonding two molded plates without bending.

Each of the fins 4 is formed to have a predetermined shape by pressing a thin metal plate made of an aluminum allow. The fin 4 is a corrugated fin without a louver, and is provided with flat contact portions 31, 32 at position corresponding to the top portion and the bottom portion of the wave shape of the corrugated fin. The contact portions 31, 32 are formed to have flat surfaces with a predetermined length, and are bonded to the outer wall surfaces of the protrusion portions 24, 25 of the molding plates 5, 6 by brazing.

As shown in FIG. 2, connection portions 33, 34 of the fin 4, connecting the contact portions 31, 32 at the top portion and the bottom portion of the wave shape, are formed into flat shapes. Accordingly, approximate rectangular shapes are formed in the fin 4 between adjacent two top portions and adjacent two bottom portions of the wave shape. As shown in FIG. 1, side plates 7, 8 are bonded to most outside fins 4 positioned at most outsides in the laminating direction. The heat-exchanging portion (core portion) of the laminated-type heat exchanger is constructed by laminating the plural tubes 3 and the plural fins 4 alternately in the laminating direction.

Figure 4:
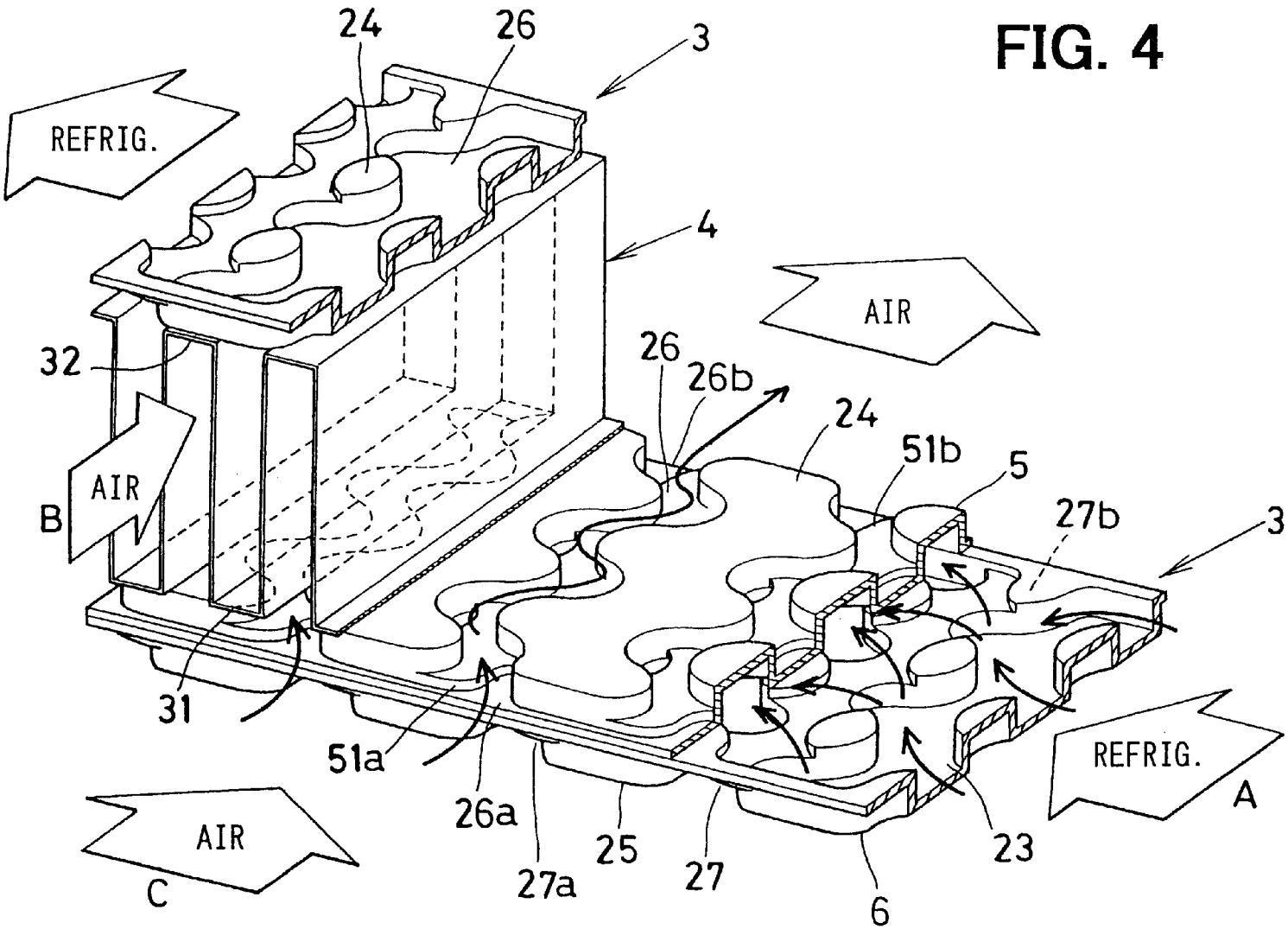
FIG. 4 is a schematic perspective view showing a refrigerant flow and an air flow in the heat-exchanging portion, according to the first embodiment.

FIG. 4 shows a refrigerant flow and an air flow in the heat-exchanging portion of the heat exchanger typically used as the condenser of the refrigerant cycle. Refrigerant flowing into the first header 1 through the connection block 11 is branched and flows into the tubes 3. Refrigerant flowing through the tubes 3 is heat-exchanged with outside air through the wall surfaces of the tubes 3 and the fins 4 attached to the outer surfaces of the protrusion portions 24, 25, so that heat of the refrigerant is transmitted to air. Here, the flow direction of refrigerant flowing through the tubes 3 is substantially perpendicular to the flow direction of air passing through the heat-exchanging portion. Accordingly, refrigerant is condensed while passing through the tubes 3, and the condensed refrigerant flows from the tubes 3 into the second header 2. Thereafter, the condensed refrigerant is discharged through the connection block 12.

As shown in FIG. 4, refrigerant flows through the refrigerant passage 23 in the tubes 3 while repeating refrigerant branching and joining, as shown by arrow A in FIG. 4. Therefore, refrigerant is effectively disturbed in the refrigerant passage 23 within the tubes 3, so that heat-transmitting performance on the refrigerant side can be improved. On the other hand, air flowing through outside the tubes 3 flows through the fins 4 as shown by arrow B in FIG. 4, and also flows through the recess portions 26, 27 on the tubes 3 from the inlet side opening portions 26*a,* 27*a* as shown by arrow C in FIG. 4.

The air shown by the arrow B in FIG. 4 smoothly flows along the fins 4, and flows out from the downstream side ends of the fins 4 after cooling the fins 4. Further, air shown by the arrow C in FIG. 4 meanderingly flows through the recess portions 26, 27, and flows out from the outlet side opening portions 26*b,* 27*b* after cooling the wall surfaces of the tubes 3.

In the laminated-type heat exchanger according to the first embodiment, the recess portions 26, 27 are provided between adjacent protrusion portions so that air meanderingly passes through the recess portions 26, 27. Therefore, air passing through the recess portions 26, 27 is effectively disturbed, and heat-transmitting performance on the air side can be improved. In addition, each recess portion 26, 27 is continuously extended from the upstream end of the tube 3 to the downstream end of the tube 3 in the air-flowing direction. Therefore, the air flow shown by the allow C in FIG. 4 is formed on the outer wall surfaces of the tubes 3, and the heat-transmitting area on the air side can be increased. Further, because the flow of air flowing into the recess portions 26, 27 is restricted in the inlet opening portions 26*a,* 27*a,* heat-transmitting performance on the air side can be improved due to the restriction flow in the inlet side opening portions 26*a,* 27*a*.

The recess portions 26, 27 are provided between adjacent two protrusion portions 24, 25, so that air meanderingly flows through the recess portions 26, 27 in the air flow direction thereby effectively improving heat-transmitting performance on the air side. The contact portions 31, 32 of the fins 4 partially contact the outer wall surface of the tubes 3. Therefore, in the first embodiment, the flat connection portions 33, 34 without a louver are provided so that heat transmission from the refrigerant is increased.

Figure 5:
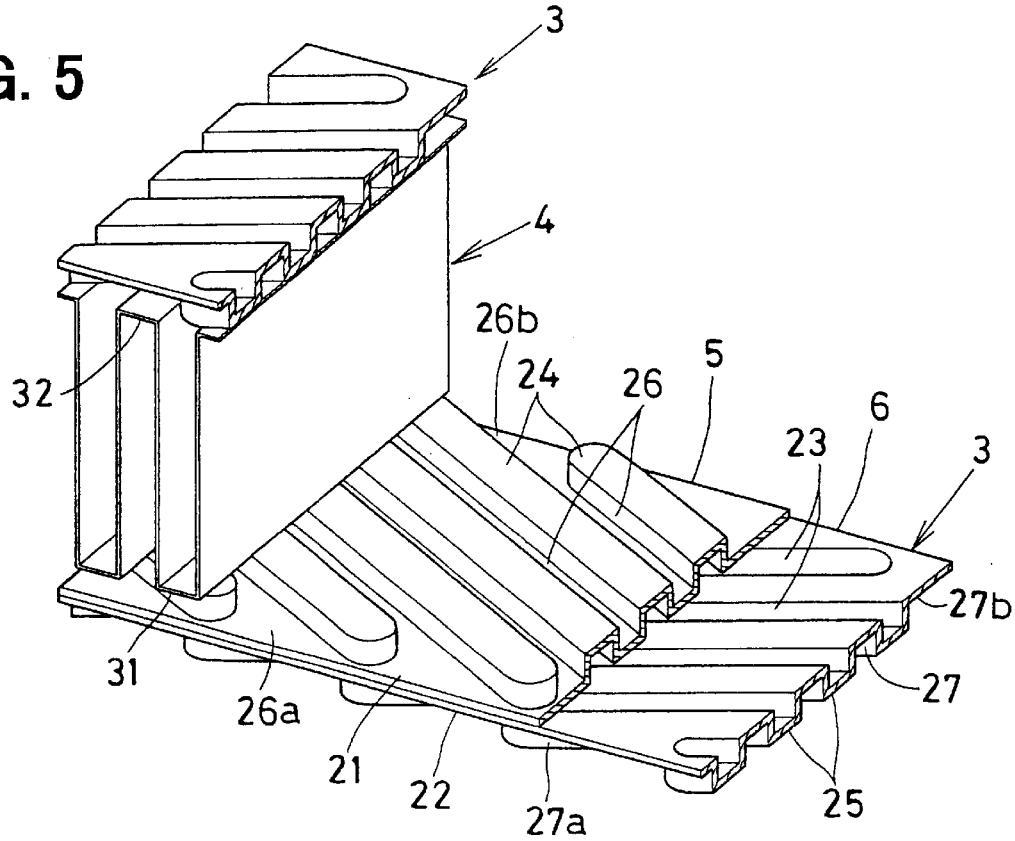
FIG. 5 is a perspective view showing a main structure of a heat-exchanging portion of a laminated-type heat exchanger according to a second preferred embodiment of the present invention.

A second embodiment of the present invention will be now described with reference to FIG. 5. As shown in FIG. 5, each of the protrusion portions 24, 25 is formed into a straight line to have two side wall surfaces and a flat top wall surface (bottom wall surface) closing one side ends of the side wall surfaces. The flat top wall surface of each protrusion portion 24, 25 has an elongated cylindrical shape. The protrusion portions 24, 25 are provided to protrude from the outer peripheral ends 21, 22 and the recess portions 26, 27 by a predetermined protrusion dimension. Further, the protrusion portions 24, 25 are provided such that each of the recess portions 26, 27 is straightly tilted by a predetermined tilt angle from the inlet side opening portions 26*a,* 27*a* to the outlet side opening portions 26*b,* 27*b*.

In the second embodiment, the pair of the molding plates 5, 6 are bonded such that the protrusion portions 24 (recess portions 26) formed on the outer wall surface of the molding plate 5 and the protrusion portions 25 (recess portions 27) formed on the outer wall surface of the molding plate 6 are crossed by a predetermined angle. Therefore, refrigerant passage 23 is formed within the tubes 3. In addition, an air passage is formed by the recess portions 26, 27 on the outer wall surfaces of the tubes 3. Because the recess portions 26, 27 are tilted straightly, air flowing into the inlet side opening portions 26*a*, 27*a* flows along the recess portions 26, 27 while being disturbed, thereby improving heat-transmitting performance on the air side.

Figure 6:
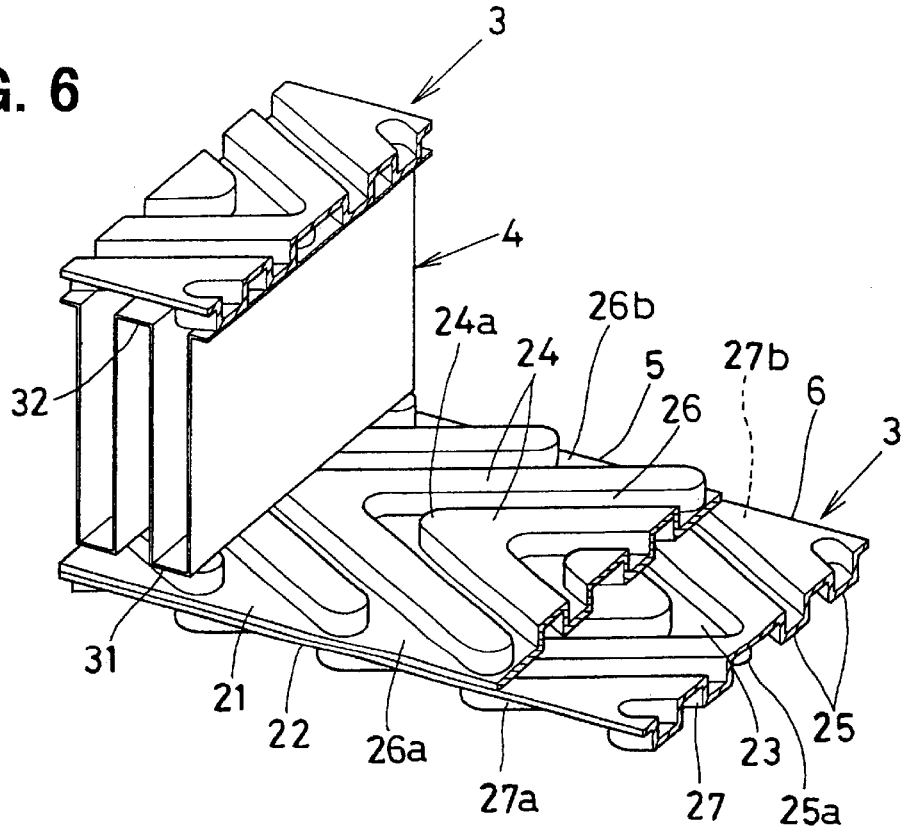
FIG. 6 is a perspective view showing a main structure of a heat-exchanging portion of a laminated-type heat exchanger according to a third preferred embodiment of the present invention.

A third preferred embodiment of the present invention will be now described with reference to FIG. 6. As shown in FIG. 6, in the third embodiment, each of the protrusion portions 24, 25 is formed into an approximate V-shape to have two side wall surfaces and a flat top wall surface (bottom wall surface). Each of the protrusion portions 24, 25 protrudes from the outer peripheral ends 21, 22 and the recess portions 26, 27 by a predetermined protrusion dimension. Each of the protrusion portions 24, 25 is formed into the approximate V-shape to have a top end portion 24*a*, 25*a* positioned on a center line in a longitudinal direction, and isosceles portions at both sides of the top end portion 24*a*, 25*a*.

In the third embodiment, the pair of the molding plates 5, 6 are bonded to each other to be slightly offset from each other in the longitudinal direction of the tube 3, such that the protrusion portions 24 (recess portions 26) formed on the outer wall surface of the molding plate 5 and the protrusion portions 25 (recess portions 27) formed on the outer wall surface of the molding plate 6 are crossed with each other by a predetermined angle. Therefore, refrigerant passage 23 is formed within the tubes 3. In addition, an air passage is formed by the recess portions 26, 27 on the outer wall surfaces of the tubes 3. Because each of the protrusion portions 24, 25 (recess portions 26, 27) has a symmetrical shape relative to the center line in the longitudinal direction, the plates 5, 6 for forming the tubes 3 can be readily formed, and product efficiency of the tubes 3 can be improved. In the third embodiment, air flowing into the inlet side opening portions 26*a*, 27*a* flows along the V-shaped recess portions 26, 27 while being disturbed, thereby improving heat-transmitting performance on the air side in the heat exchanger.

Figure 7:
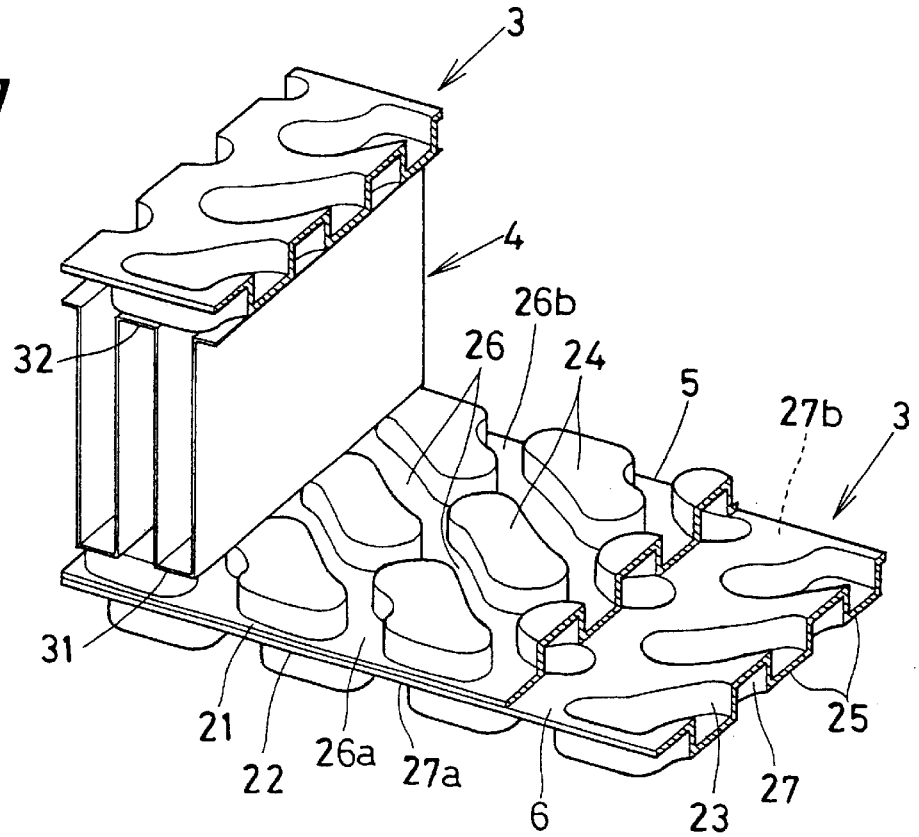
FIG. 7 is a perspective view showing a main structure of a heat-exchanging portion of a laminated-type heat exchanger according to a fourth preferred embodiment of the present invention.

A fourth embodiment of the present invention will be now described with reference to FIG. 7. As shown in FIG. 7, each of the protrusion portions 24, 25 is formed into an elongated round shape shown in FIG. 7, to have a side wall surface and a flat top wall surface (bottom wall surface) closing one side end of the side wall surface. The plural small protrusion portions 24, 25 are provided to protrude from the outer peripheral ends 21, 22 and the recess portions 26, 27 by a predetermined protrusion dimension. In the fourth embodiment, the pair of the molding plates 5, 6 are bonded to each other, such that the protrusion portions 24 (recess portions 26) formed on the outer wall surface of the molding plate 5 and the protrusion portions 25 (recess portions 27) formed on the outer wall surface of the molding plate 6 are slightly offset from each other in the longitudinal direction of the tube 3.

Each of the protrusion portions 24, 25 is formed into an elongated small protrusion as shown in FIG. 7. Therefore, refrigerant passage 23 is formed within the tubes 3. In addition, an air passage is formed by the recess portions 26, 27 between adjacent protrusion portions 24, 25 on the outer wall surfaces of the tubes 3. In the fourth embodiment, the protrusion portions 24, 25 are arranged in the tube longitudinal direction, and are arranged in plural rows in a direction (air-flowing direction) perpendicular to the tube longitudinal direction. In addition, the protrusion portions 24, 25 are arranged such that the recess portions 26, 27 between adjacent the protrusion portions 24, 25 and around the protrusion portions 24, 25 communicate with each other in the air-flowing direction. Because adjacent the recess portions 26, 27 are communicated with each other in the air-flowing direction, air flowing into the inlet side opening portions 26*a*, 27*a* flows along the recess portions 26, 27 while being disturbed, thereby improving heat-transmitting performance on the air side.

Figure 8:
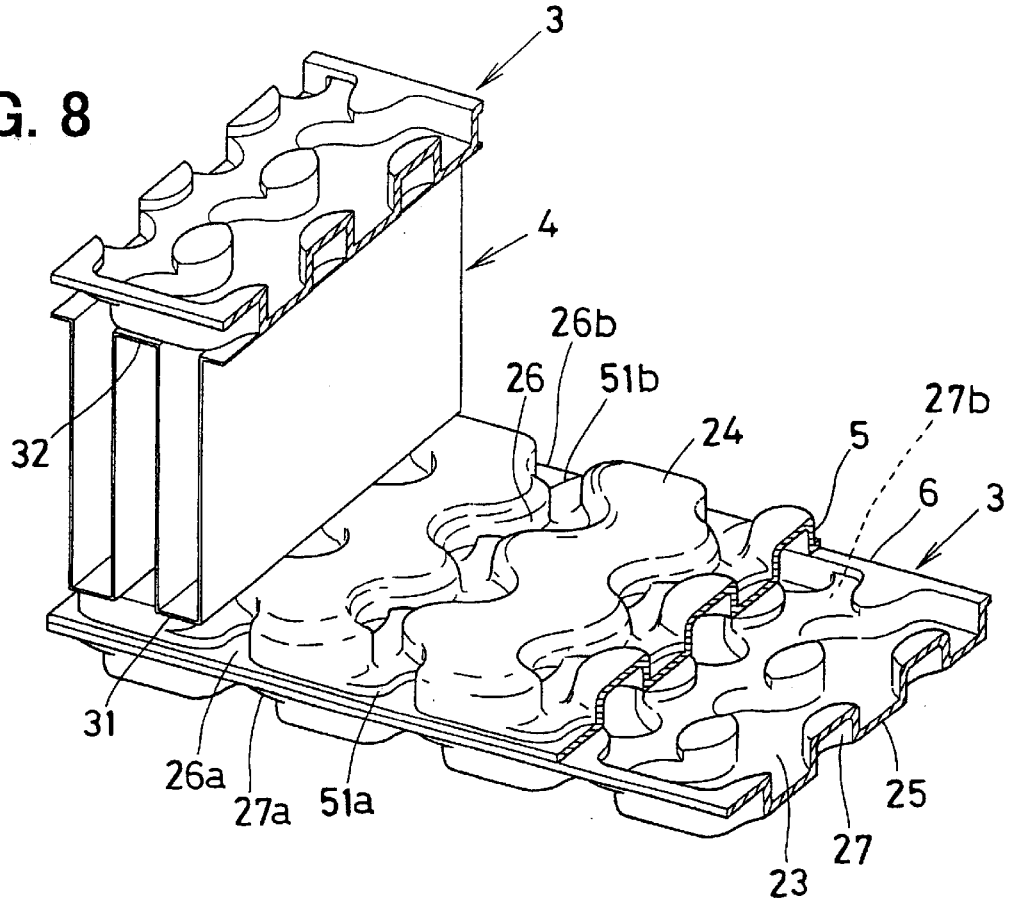
FIG. 8 is a perspective view showing a main structure of a heat-exchanging portion of a laminated-type heat exchanger according to a fifth preferred embodiment of the present invention.

A fifth preferred embodiment of the present invention will be now described with reference to FIG. 8. In the fifth embodiment, as shown in FIG. 8, the side wall surface constructing the protrusion portions 24, 25 is formed into a step shape or a taper shape. In addition, step portions 51*a*, 51*b* are provided around the inlet side opening portions 26*a*, 27*a* and the outlet side opening portions 26*b*, 27*b* of the recess portions 26, 27. Therefore, air passing through the recess portions 26, 27 can be effectively disturbed, and the heat-transmitting performance on the air side can be improved.

Figure 9:
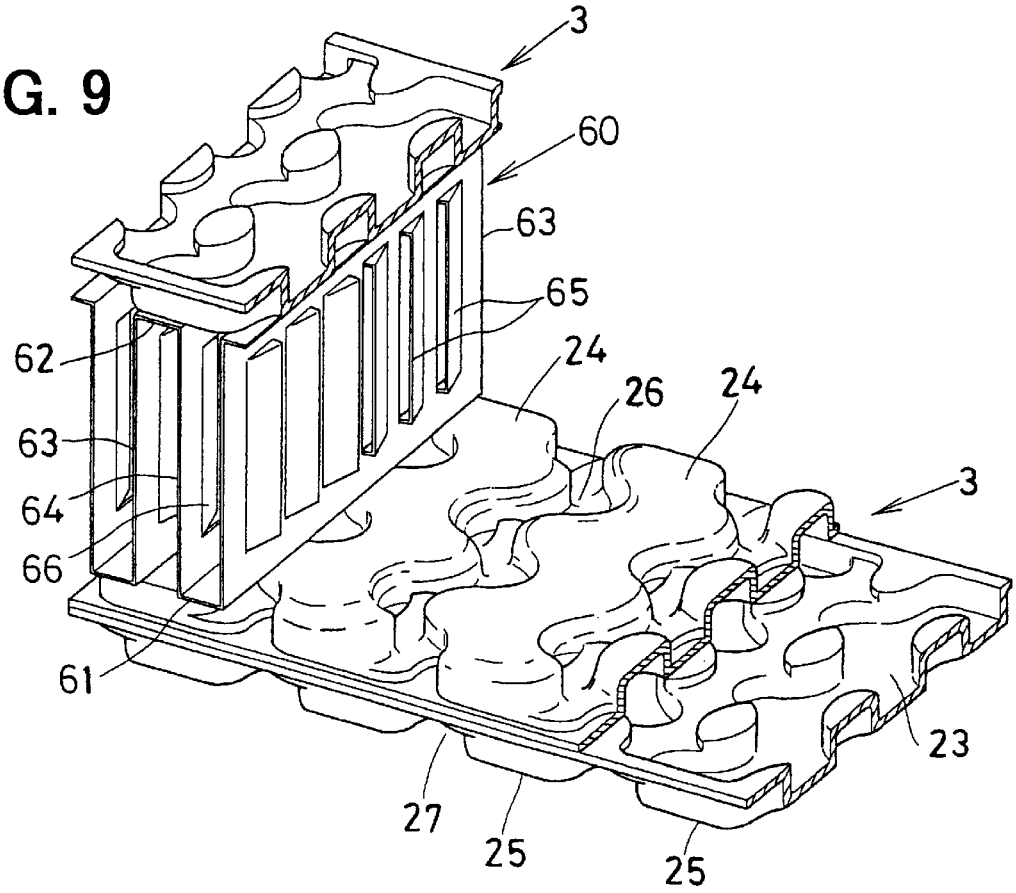
FIG. 9 is a perspective view showing a main structure of a heat-exchanging portion of a laminated-type heat exchanger according to a sixth preferred embodiment of the present invention.

A sixth preferred embodiment of the present invention will be now described with reference to FIG. 9. In the sixth embodiment, corrugated fins 60 with louvers are used between adjacent tubes 3. Specifically, heat-transmission facilitating portions 65, 66 such as louvers are provided in connection portions 63, 64 connecting contact portions 61, 62 contacting the outer wall surfaces of the tubes 3. The contact portions 61, 62 are provided at the top portions and the bottom portions of the wave shape in the corrugated fins 60. In this case, air meanderingly passes through the corrugated fins 60. In the sixth embodiment, the shapes of the heat-transmission facilitating portions 65, 66 can be suitably changed.

Figure 10:
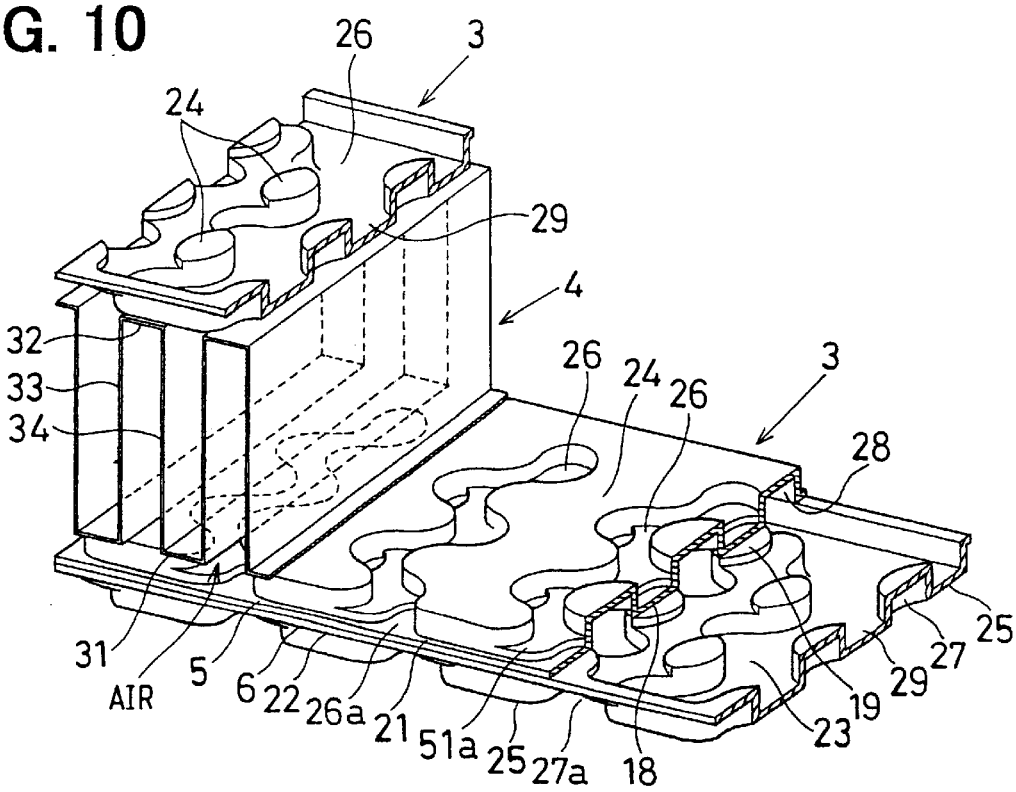
FIG. 10 is a perspective view showing a main structure of a heat-exchanging portion of a laminated-type heat exchanger according to a seventh preferred embodiment of the present invention.

A seventh preferred embodiment of the present invention will be now described with reference to FIG. 10. In the above-described embodiments, the recess portions 26, 27 provided on the outer wall surfaces of the tubes 3 are provided with the inlet side opening portions 26*a*, 27*a* and the outlet side opening portions 26*b*, 27*b*. However, in the seventh embodiment, only the inlet side opening portions 26*a*, 27*a* are provided in the recess portions 26, 27, at the upstream end of the tube 3 in the air-flowing direction, as shown in FIG. 10. Alternately, only the outlet side opening portions can be provided in the recess portions 26, 27, at the downstream end of the tube 3 in the air-flowing direction.

Specifically, in the seventh embodiment, as shown in FIG. 10, a refrigerant passage is formed within the tubes 3 by bonding a pair of molding plates 5, 6. The protrusion portions 24 and the recess portions 26 of the molding plate 5 and the protrusion portions 25 and the recess portions 27 of the molding plates 6 are slightly offset in the longitudinal direction of the pair of the forming plates 5, 6. Accordingly, refrigerant in the refrigerant passage 23 passes through recess portions 28 formed inside the protrusion portions 24 of the molding plate 5, then passes through recess portions 29 formed inside the protrusion portions 25 of the molding plate 6, then passes through the recess portions 28 formed inside the protrusion portions 24 of the molding plate 5, and then passes through recess portions 29 formed inside the protrusion portions 25 of the molding plate 6. That is, refrigerant passes through the refrigerant passage 23 from the first header 1 to the second header 2, while alternately passing through the recess portions 28 formed inside the protrusions portions 24 of the molding plate 5 and the recess portions 29 formed inside the protrusions portions 25 of the molding plate 6. In the seventh embodiment, in order to increase the pressure-resistance strength of the tube 3, connection portions 18, 19 at which both the plates 5, 6 are connected are provided, similarly to the first embodiment.

Similarly to the first embodiment, a thin metal plate made of an aluminum allow or the like is molded to form protrusion and recess shapes. Thereafter, the molded plates 5, 6 are bonded to form the tube 4. The tube 4 may be formed by bending a molded plate similarly to the first embodiment.

In the seventh embodiment, the recess portions 26, 27 are formed by the protrusion portions 24, 25, between the outer wall surfaces of the tubes 3 and the contact portions 31, 32 of the fins 4. Each of the recess portions 26, 27 has a wave shape to be not fully closed by the contact portions 31, 32 of the fins 4.

Further, the step portions 51*a* are provide around the inlet side opening portions 26*a*, 27*a* of the recess portions 26, 27. Each of the step portions 51*a* has a dimension about 0.65 mm, for example. However, the step portion 51*a* may be not provided in the inlet side opening portions 26*a*, 27*a*.

In the seventh embodiment, the recess portions 26, 27 only having the inlet side opening portions 26*a*, 27*a* are provided on the outer wall surfaces of the tubes 3 between adjacent the protrusion portions 24, 25. Therefore, air passing outside the tubes 3 flows through the fins 4 and flows into the recess portions 26, 27 through the inlet side opening portions 26*a*, 27*a*. Because the recess portions 26, 27 communicate with the air passages in the fins 4, air flows into the recess portions 26, 27 through the inlet side opening portions 26*a*, 27*a* does not stay in the recess portions 26, 27, but passes through the recess portions 26, 27.

In addition, air flowing into the inlet side opening portions 26*a*, 27*a* meanderingly flows through the recess portions 26, 27 toward downstream air ends of the tubes 3. Therefore, air is disturbed while flowing through the recess portions 26, 27. Accordingly, the heat-transmitting performance on the air side can be improved.

An eighth preferred embodiment of the present invention will be now described with reference to FIGS. 11 and 12. In the eighth embodiment, a heat-exchanging portion of a heat exchanger is constructed by plural flat tubes 71 each of which has therein plural refrigerant passages 72, plural fines 73 for facilitating heat exchange between air and refrigerant, and plural punched plates 75 used intermediate plates between adjacent the tube 71 and the fin 73. Each of the tubes 71 having flat outer wall surfaces is made of a metal such as an aluminum allow, and is formed by an extrusion to have therein the refrigerant passages 72. Each of the fins 73 is formed by a heat conductive member, and is disposed to facilitate the heat exchange between refrigerant flowing through the refrigerant passages 72 and air passing through outside the tubes 71. Each of the punched plates 75 is provided with plural punched holes 74 through which air passes, and is disposed between the outer wall surface of each tube 71 and contact portions 52, 53 of each fin 73. The punched plates 75 are made of a metal having a sufficient heat conductivity. That is, one punched plate 75 having the punched holes 74 is inserted between adjacent the flat tube 71 and the fin 73, so that the heat-exchanging portion of the laminated-type heat exchanger is constructed.

The punched holes 74 are provided in each punched plate 75 to penetrate through the punched plate 75 in the plate thickness direction of the punched plate 75. The punched holes 74 define an air passage in which air flows. When the punched plate 75 is bonded to the flat outer wall surface of the flat tube 71, the punched holes 74 can be used as the recess portions described in the seventh embodiment. Opening portions 76 for introducing air into the punched holes 74 are provided in the punched holes 74 at an upstream end of the punched plate 75 in the air-flowing direction. Alternately, opening portions for discharging air in the punched holes 74 can be provided in the punched holes 74 at a downstream end of the punched plate 75 in the air-flowing direction. Similarly to the above-described seventh embodiment, each of the punched holes 74 is formed into a shape so that the punched holes communicate with the air passage in the fins 73.

Figure 11:
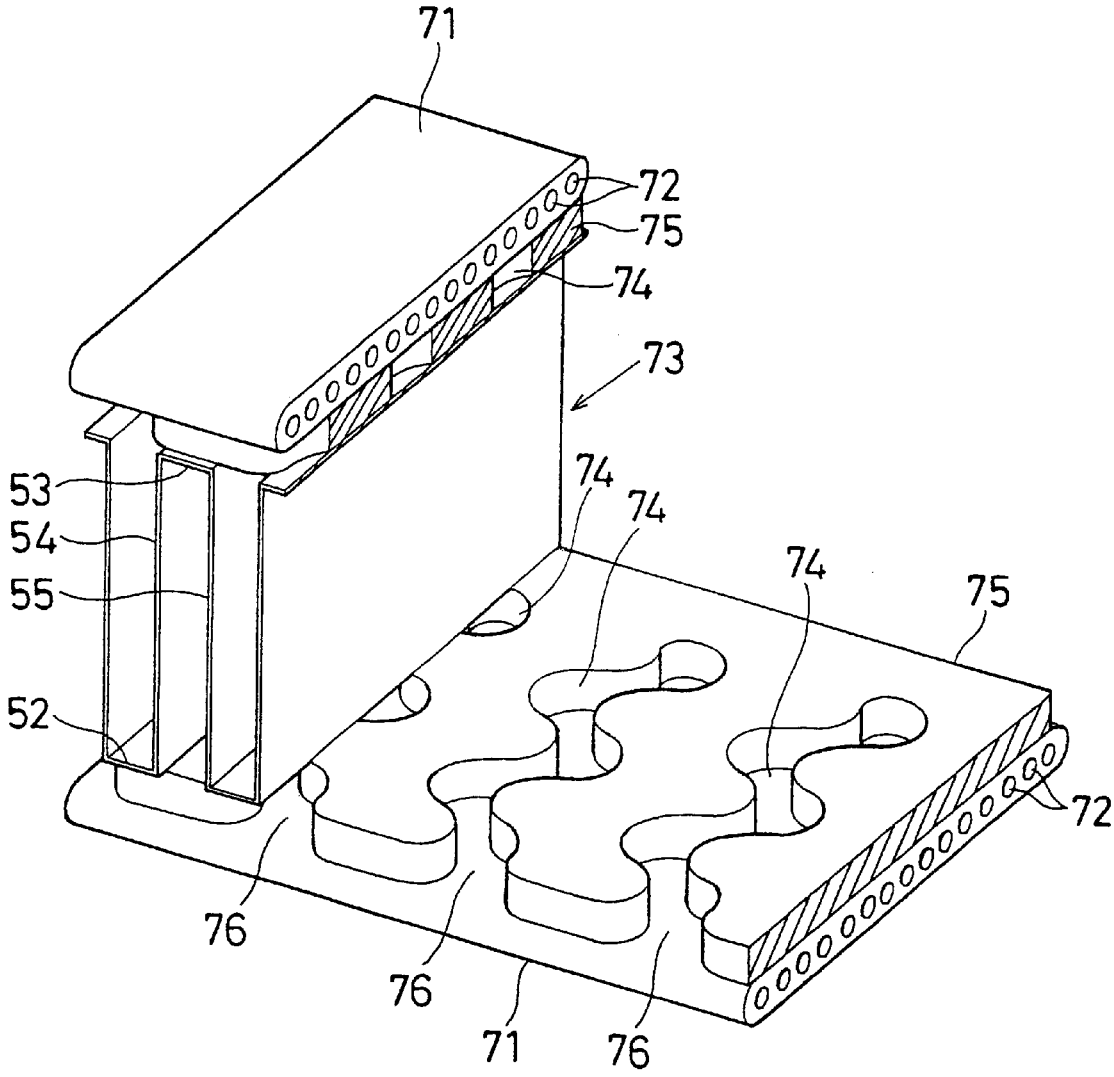
FIG. 11 is a perspective view showing a main structure of a heat-exchanging portion of a laminated-type heat exchanger according to an eighth preferred embodiment of the present invention.
Figure 12:
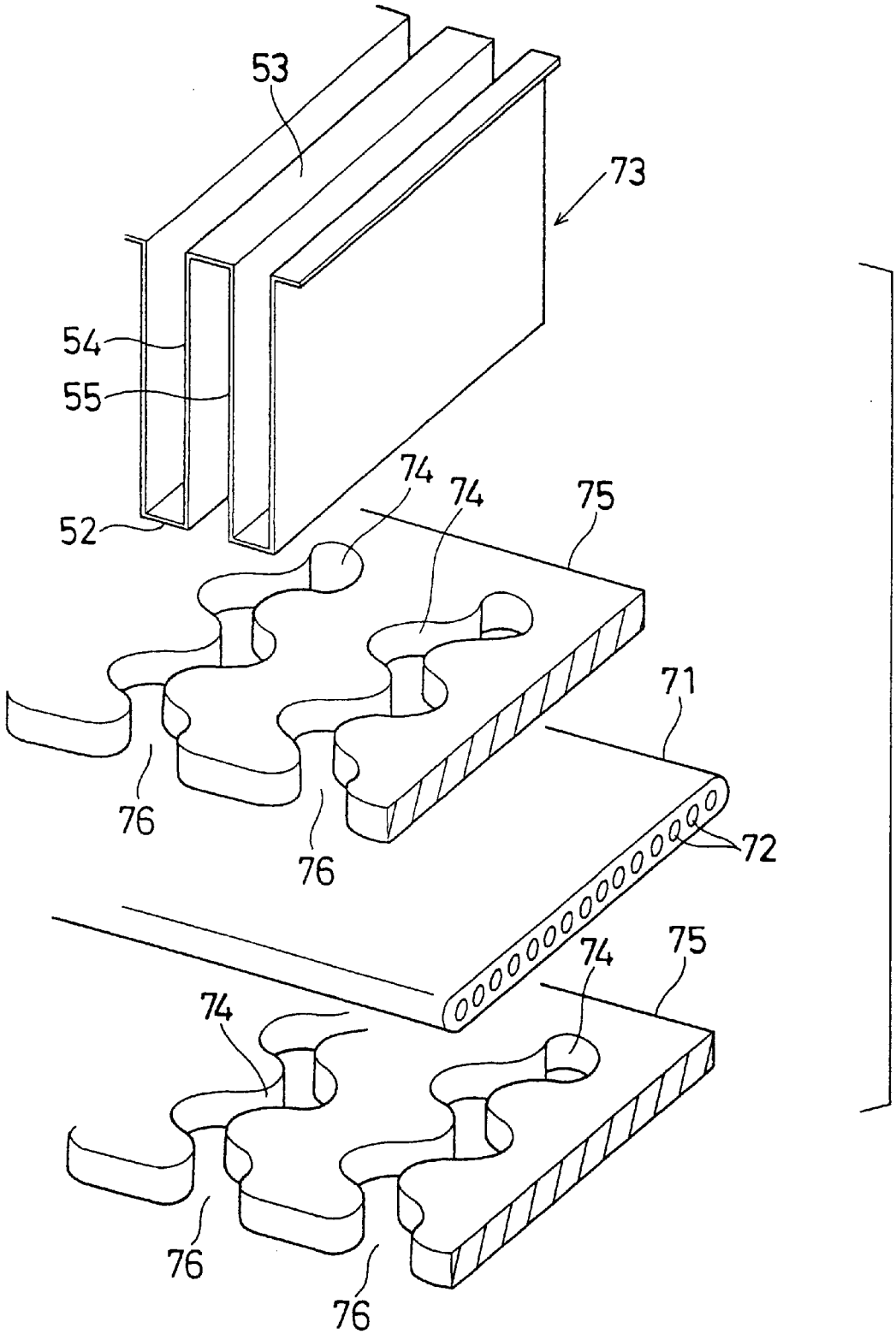
FIG. 12 is a perspective view showing a main structure of a heat-exchanging portion of a laminated-type heat exchanger according to the eighth embodiment.
Figure 13:
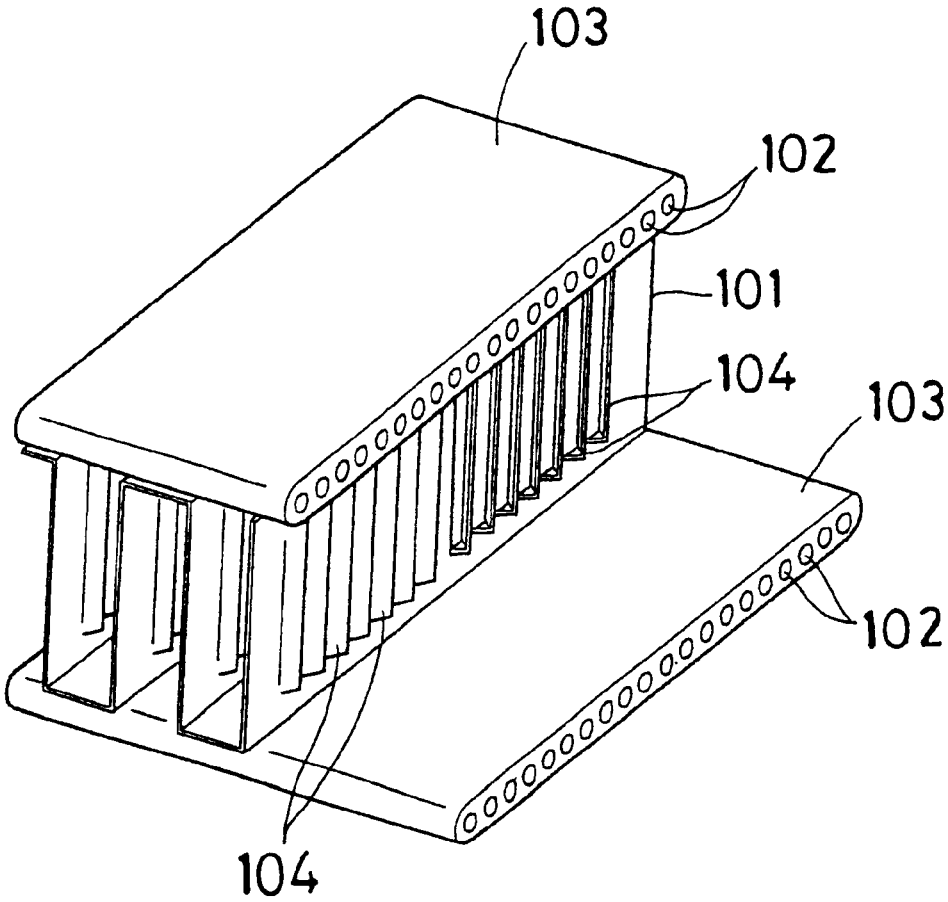
FIG. 13 PRIOR ART
FIG. 13 is a perspective view showing a main structure of a heat-exchanging portion in a conventional laminated-type heat exchanger.
Figure 14A:
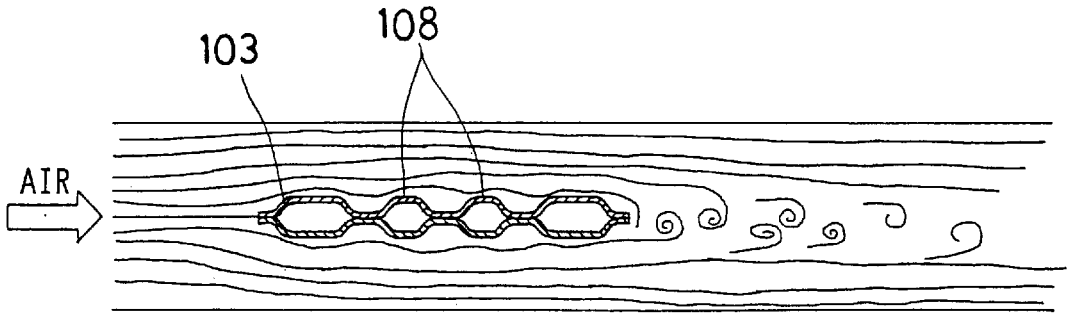
FIG. 14A PRIOR ART
FIG. 14A is a schematic diagram showing an air flow in a conventional laminated-type heat exchanger.
Figure 14B:
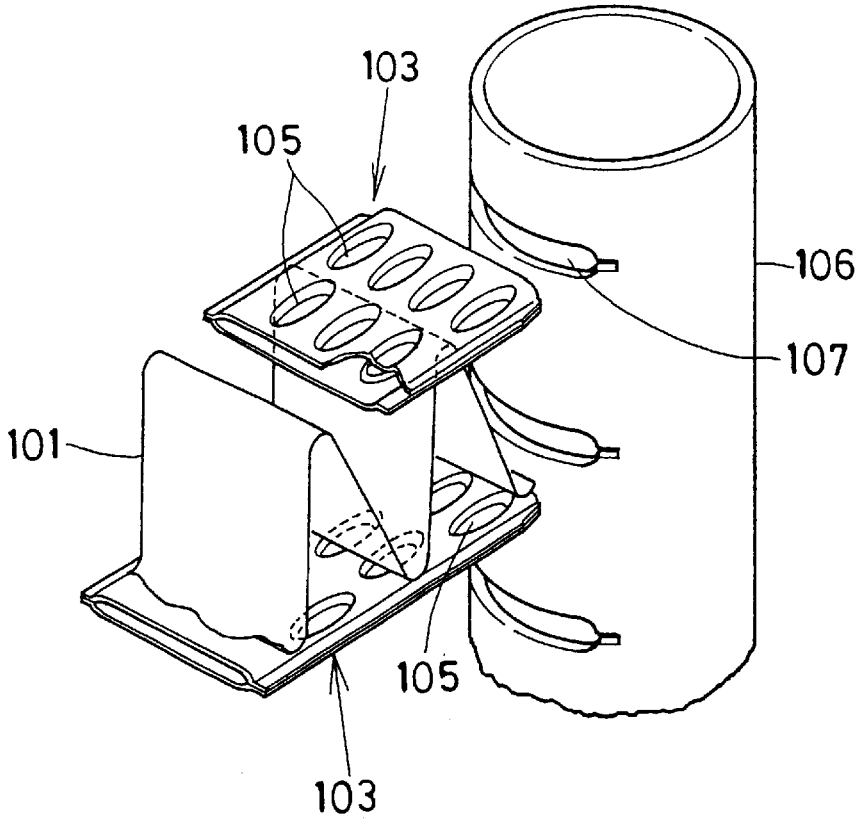
FIG. 14B PRIOR ART
FIG. 14B is a perspective view showing a main structure of a heat-exchanging portion in the conventional laminated-type heat exchanger.

As shown in FIGS. 11 and 12, because each of the recess portions 74 is formed into a wave shape in the air-flowing direction, air meanderingly flows through the punched holes 74 from the opening portions 76 toward the downstream air side end of the punched plate 75, without being stayed in the punched holes 74. Therefore, air passing through the punched holes 74 is disturbed, and heat-transmitting performance can be effectively improved on the air side. In the eight embodiment, the contact portions 52, 53 of the fins 73 partially contact the surfaces of the punched plates 75. Therefore, flat plates without a louver are used as the connection portions 54, 55 of the fins 73, for improving the heat-transmitting performance from the refrigerant.

Although the present invention has been fully described in connection with the preferred embodiments thereof with reference to the accompanying drawings, it is to be noted that various changes and modifications will become apparent to those skilled in the art.

For example, in the above-described embodiments, the laminated-type heat exchanger of the present invention is typically used for the condenser of the refrigerant cycle of the vehicle air conditioner. However, the laminated-type heat exchanger may be applied to a refrigerant condenser of a refrigerant cycle for a home or a factory.

In each of the above-described first through sixth embodiments of the present invention, the inlet side opening portions 26*a*, 27*a* and the outlet side opening portions 26*b*, 27*b* are provided at the upstream air side end and the downstream air side end in each tube 3. However, the opening portions may be provided at only one side end among the upstream air side end and the downstream air side end of the tube 3. That is, the recess portions 26, 27 can be provided with only the inlet side opening portions 26*a*, 27*a* or the outlet side opening portions 26*b*, 27*b*. Alternatively, the recess portions 26, 27 only having the inlet side opening portions 26*a*, 27*a* and the recess portions 26, 27 only having the outlet side opening portions 26*b*, 27*b* may be alternately arranged to have a predetermined pattern.

Similarly, in the above-described seventh and eighth embodiments of the present invention, opening portions for flowing out air in the punched holes 74 may be provided at the downstream air side end of each punched plate 75. Alternatively, first punched holes 74 only having inlet side opening portions 76 at the upstream air side and second punched holes only having outlet side opening portions at the downstream air side can be alternately arranged in the punched plate 75.

In the above-described embodiments of the present invention, an air-flowing width in each of the recess portion 26, 27 and in each punched hole 74 may be changed. For example, the air-flowing width in each of the recess portion 26, 27 and in each punched hole 74 can be set to be gradually increased or gradually decreased. Alternatively, the air-flowing width in each of the recess portion 26, 27 and in each punched hole 74 may be partially enlarged or partially restricted in the middle portion.

Further, in the above-described seventh and eighth embodiments of the present invention, the punched holes 74 may be formed into recess portions having bottom surfaces. That is, the punched holes 74 are unnecessary to penetrate through the punched plate 75 in the plate thickness direction.

Such changes and modifications are to be understood as being within the scope of the present invention as defined by the appended claims.

What is claimed is:

1. A heat exchanger comprising:

a plurality of flat tubes for performing a heat exchange between a first fluid flowing inside the tubes and a second fluid flowing outside the tubes; and a plurality of heat transmitting members for increasing a heat-exchanging efficiency between the first fluid and the second fluid, each of which is disposed between adjacent tubes and has contact portions contacting an outer wall surface of each tube adjacent to each heat transmitting member, wherein each of the tubes has a plurality of protrusion portions protruding from the outer wall surface of each tube toward the heat transmitting members to define a fluid passage between adjacent protrusion portions such that the second fluid passes through the fluid passage defined between the adjacent protrusion portions; and wherein each of the protrusion portions has a one-side opened approximate rectangular shape.

2. A heat exchanger comprising:

a plurality of flat tubes for performing a heat exchange between a first fluid flowing inside the tubes and a second fluid flowing outside the tubes; and a plurality of heat transmitting members for increasing a heat-exchanging efficiency between the first fluid and the second fluid, each of which is disposed between adjacent tubes and has contact portions contacting an outer wall surface of each tube adjacent to each heat transmitting member, wherein each of the tubes has a plurality of protrusion portions protruding from the outer wall surface of each tube toward the heat transmitting members to define a fluid passage between adjacent protrusion portions such that the second fluid passes through the fluid passage defined between the adjacent protrusion portions; and wherein each of the protrusion portions has an approximate U-shape.

3. A heat exchanger comprising:

a plurality of flat tubes for performing a heat exchange between a first fluid flowing inside the tubes and a second fluid flowing outside the tubes; and a plurality of heat transmitting members for increasing a heat-exchanging efficiency between the first fluid and the second fluid, each of which is disposed between adjacent tubes and has contact portions contacting an outer wall surface of each tube adjacent to each heat transmitting member, wherein each of the tubes has a plurality of protrusion portions protruding from the outer wall surface of each tube toward the heat transmitting members to define a fluid passage between adjacent protrusion portions such that the second fluid passes through the fluid passage defined between the adjacent protrusion portions; and wherein each of the protrusion portions has an approximate C shape.

4. A heat exchanger comprising:

a plurality of flat tubes for performing a heat exchange between a first fluid flowing inside the tubes and a second fluid flowing outside the tubes; and a plurality of heat transmitting members for increasing a heat-exchanging efficiency between the first fluid and the second fluid, each of which is disposed between adjacent tubes and has contact portions contacting an outer wall surface of each tube adjacent to each heat transmitting member, wherein each of the tubes has a plurality of protrusion portions protruding from the outer wall surface of each tube toward the heat transmitting members to define a fluid passage between adjacent protrusion portions such that the second fluid passes through the fluid passage defined between the adjacent protrusion portions; wherein:

each of the contact portions has a flat surface;

the heat transmitting members are corrugated fins disposed to contact the outer wall surfaces of the tubes on the flat surfaces of the contact portions; and each of the corrugated fins is a continuously extending fin.

5. A heat exchanger comprising:

a plurality of flat tubes for performing a heat exchange between a first fluid flowing inside the tubes and a second fluid flowing outside the tubes; and a plurality of heat transmitting members for increasing a heat-exchanging efficiency between the first fluid and the second fluid, each of which is disposed between adjacent tubes and has contact portions contacting an outer wall surface of each tube adjacent to each heat transmitting member, wherein each of the tubes has a plurality of protrusion portions protruding from the outer wall surface of each tube toward the heat transmitting members to define a fluid passage between adjacent protrusion portions such that the second fluid passes through the fluid passage defined between the adjacent protrusion portions; wherein:

each of the contact portions has a flat surface;

the heat transmitting members are corrugated fins disposed to contact the outer wall surfaces of the tubes on the flat surfaces of the contact portions; and each of the corrugated fins has louvers.

6. A heat exchanger comprising:

a plurality of flat tubes for performing a heat exchange between a first fluid flowing inside the tubes and a second fluid flowing outside the tubes; and a plurality of heat transmitting members for increasing a heat-exchanging efficiency between the first fluid and the second fluid, each of which is disposed between adjacent tubes and has contact portions contacting an outer wall surface of each tube adjacent to each heat transmitting member, wherein each of the tubes has a plurality of protrusion portions protruding from the outer wall surface of each tube toward the heat transmitting members to define a fluid passage between adjacent protrusion portions such that the second fluid passes through the fluid passage defined between the adjacent protrusion; and wherein each of the contact portions of the heat transmitting member contacts at least a part of two adjacent protrusion portions.

7. The heat exchanger according to claim 6, wherein the fluid passage is provided around the protrusion portions.

8. The heat exchanger according to claim 6, wherein:

the fluid passage is provided between the outer wall surface of each tube and the contact portions of each heat transmitting member; and the fluid passage is constructed by at least groove-shaped recess portions between adjacent protrusion portions.

9. The heat exchanger according to claim 8, wherein:

the fluid passage has at least one side opening between inlet side openings for introducing the second fluid into the recess portions and outlet side openings for allowing the second fluid to flow from the recess portions;

the inlet side openings are provided at an upstream end side of each tube in a flow direction of the second fluid; and the outlet side openings are provided at a downstream end side of each tube in the flow direction of the second fluid.

10. The heat exchanger according to claim 9, wherein the protrusion portions are provided such that the recess portions meander from the inlet side openings toward the outlet side openings.

11. The heat exchanger according to claim 9, wherein the protrusion portions are provided such that the recess portions are tilted substantially straight from the inlet side openings toward the outlet side openings.

12. The heat exchanger according to claim 9, wherein each of the protrusion portions has a symmetrical shape relative to a center line in a longitudinal direction of the tube.

13. The heat exchanger according to claim 6, wherein:

the protrusion portions are arranged in each tube in a tube longitudinal direction; and each of the protrusion portions continuously extends from an upstream end of each tube in a flow direction of the second fluid to a downstream end of each tube in the flow direction of the second fluid.

14. The heat exchanger according to claim 8, wherein each of the recess portions is provided such that the contact portions of the heat transmitting members partially contact the outer wall surfaces of the tubes.

15. The heat exchanger according to claim 6, wherein the protrusion portions are arranged in each tube to have a plurality of protrusion lines in a tube longitudinal direction and to have a plurality of protrusion rows in a flow direction of the second fluid.

16. The heat exchanger according to claim 15, wherein each of the protrusion portions protrudes to have a protrusion top surface with an approximate elongated round shape.

17. A heat exchanger comprising:

a plurality of flat tubes for performing a heat exchange between a first fluid flowing inside the tubes and a second fluid flowing outside the tubes; and a plurality of heat transmitting members for increasing a heat-exchanging efficiency between the first fluid and the second fluid, each of which is disposed between adjacent tubes; and a plurality of intermediate plates each of which is disposed between a respective tube and a respective heat transmitting member, wherein each of the intermediate plates has a fluid passage through which the second fluid passes.

18. The heat exchanger according to claim 17, wherein:

the fluid passage is constructed by a plurality of recess portions recessed in a plate thickness direction of each intermediate plate; and the fluid passage has at least one side opening between inlet side openings from which the second fluid flows into the recess portions, and outlet side openings from which the second fluid flows out from the recess portions.

19. The heat exchanger according to claim 17, wherein:

the fluid passage is constructed by a plurality of holes penetrating through each intermediate plate in a plate thickness direction of each intermediate plate; and the fluid passage has at least one side opening between inlet side openings from which the second fluid flows into the holes, and outlet side openings from which the second fluid flows out from the holes.

20. The heat exchanger according to claim 17, wherein the fluid passage in each intermediate plate is provided such that the second fluid flows through the fluid passage meanderingly from an upstream end side toward a downstream end side of each intermediate plate in a flow direction of the second fluid.

* * * * *